United States Patent [19]

dePolo

[11] 4,368,547

[45] Jan. 18, 1983

[54] GARMENTS FORMED OF HELICALLY WOUND MATERIAL AND METHOD OF MAKING SAME

[76] Inventor: Harry R. dePolo, 480 Park Ave., New York, N.Y. 10022

[21] Appl. No.: 287,368

[22] Filed: Jul. 27, 1981

Related U.S. Application Data

[63] Continuation-in-part of Ser. No. 176,522, Aug. 8, 1980.

[51] Int. Cl.[3] ..... A41B 11/04

[52] U.S. Cl. ..... 2/409; 2/227

[58] Field of Search ..... 2/409, 227, 243 A, 243 B, 2/211

[56] References Cited

U.S. PATENT DOCUMENTS 608,529 10/1900 Johnson ..... 2/175

3,154,792 11/1964 Lobel ..... 2/211

*Primary Examiner*—Doris L. Troutman

*Attorney, Agent, or Firm*—Robert E. Burns; Emmanuel J. Lobato; Bruce L. Adams

[57] ABSTRACT

In a method of making garments by helically winding bands of material, the bands are laid out side-by-side on stock material of predetermined width and the width of the bands is selected so that the sum of the widths of the bands is equal to the width of the material. This achieves a high degree of material utilization. The sizes of garments to be produced is independent, within limits, of the widths of the band, since larger or smaller garments can be made by varying the length of the bands and controlling the helical winding. In making pants-type garments, side extension pieces of generally triangular or trapezoidal form are joined to side edges of first and second bands which are helically wound to form the legs. Such side extension pieces are laid out on the material in alternately reversed, intercalated relation and adjusted lengthwise relative to one another so that the sum of the width of pairs of side extension pieces is equal to the width of the material. In making dress-type garments, a band to be wound helically to form a body portion of the garment is shaped so as to impart shape to the garment and may be cut as a plurality of pieces which are then joined.

22 Claims, 26 Drawing Figures

K
K1
K2
B3
B2
B1
C
C1
D
E
F
A
B
1
1a
1b
1c
1d
2
2a
2b
2c
3
3a
3b
3c
3d
4
4a
4b
4c 1
2
3
4
B2
B1
K
K1
C
C1
D
E
E1

GARMENTS FORMED OF HELICALLY WOUND MATERIAL AND METHOD OF MAKING SAME

REFERENCE TO PRIOR APPLICATION

This application is a continuation-in-part of my application Ser. No. 176,522 filed Aug. 8, 1980 and is directed to further development of the invention disclosed in my U.S. Pat. No. 4,097,933.

FIELD OF INVENTION

The present invention relates to the construction of garments formed by winding a band of material helically and joining contiguous edges of adjacent convolutions of the helically wound material to form the garment. One aspect of the invention relates to cutting the pieces of material from which the garments are to be formed from stock material of a predetermined width in such manner as to avoid fabric loss and thereby achieve a high degree of material utilization. A further aspect of the invention relates to the construction of pants-type garments. The term "pants-type garment" is used in a broad sense to include pants, slacks, jeans, shorts, cullottes, overalls, coveralls, and similar garments which have a body portion covering at least the lower portion of the torso and leg portions individually covering at least portions of the legs of a wearer. The present invention is applicable to garments of all sizes for men, women, children and infants.

BACKGROUND OF THE INVENTION

In a conventional method of garment construction, pieces of various shapes and sizes are cut from stock material according to a pattern and then sewed together to form a garment. In an effort to minimize fabric loss, the pieces are laid out and, in so far as possible, fitted together on the fabric in the manner of a jigsaw puzzle. However, even with the use of computers, a material utilization of 80% is considered good. As the pieces for the most part do not have straight edges, they cannot be laid along the edge of the fabric so as to utilize the selvage as a finished edge and thereby reduce edge finishing operations. Moreover, edges of adjacent pieces are not usually coincident so as to make possible a single cut between the pieces.

In U.S. Pat. No. 4,097,933 there are disclosed garments formed by bands of material which are wound helically and have adjacent edges of successive convolutions of the material joined along helical junction lines to form the garment. The garments disclosed include dress-type garments such as dresses, slips, blouses, coats, jackets, nightgowns, hostess coats, skirts, and other sheath-type garments for covering or partially covering the torso and in some cases the legs of a wearer. This patent also discloses pants-type garments such as pants, slacks, jeans, shorts, cullottes, overalls, coveralls and similar garments which have a body portion covering at least the lower portion of the torso and leg portions individually covering at least portions of the legs of a wearer. Garments of this construction represent an important improvement over earlier garments made by using patterns to cut pieces of various sizes and shapes from fabric material and then sewing the pieces together to form the garment.

SUMMARY OF THE INVENTION

The present invention is directed to a further development of the invention disclosed in U.S. Pat. No. 4,097,933. In accordance with one aspect of the present invention, pieces of material for forming a garment by winding at least one band of material helically and joining contiguous edges of adjacent convolutions to form the garment are cut from stock material of predetermined width in such manner as to minimize fabric loss and thereby achieve a high degree of material utilization. In accordance with the invention a plurality of bands to be used in the garment construction are laid out side-by-side on the stock material with the sum of the width of the bands equal to the width of material so that waste of material is avoided. As the bands are immediately adjacent one another without intervening material between them, only a single cut is required between adjacent bands. Moreover, as the outer edges of the outermost bands are formed by the selvage edges of the material, these edges do not require finishing to prevent fraying or raveling.

In accordance with the invention bands of the same width can be used for producing garments of different sizes so that it is not necessary to have a different width band for each size. While using the same width, band different sizes of garments can be produced by varying the lengths of the bands and controlling the helical winding of the bands to produce garments of the desired sizes. This makes it possible to divide stock material of predetermined width into a selected number of bands without waste material between the bands or at the edges of the material.

In making pants-type garments a band of material is helically wound to form each leg and upper portions of the bands are joined to form a body portion of the garment. In accordance with another aspect of the present invention, a side extension piece of material having an upper edge, an outer side edge and an inner side edge having an inclined lower portion is joined to one side of at least an upper portion of each of the leg-forming bands of material so as to form an inclined lateral extension of the band. Upper portions of the band and the respective side extension piece are contoured to provide a waistline and crotch construction. The two leg portions are then joined along a central junction line to form the body portion of the garment. The side extension pieces provide greater fullness and accommodate large waist dimensions. The side extension pieces may extend down as far as knee level of the garment or, if desired, even to the lower edge of the garment.

BRIEF DESCRIPTION OF DRAWINGS

The nature, objects and advantages of the invention will be more fully understood from the following description of preferred embodiments illustrated by way of example in the accompanying drawings in which.

DESCRIPTION OF PREFERRED EMBODIMENTS

Figures 1, 2, 3, 4:
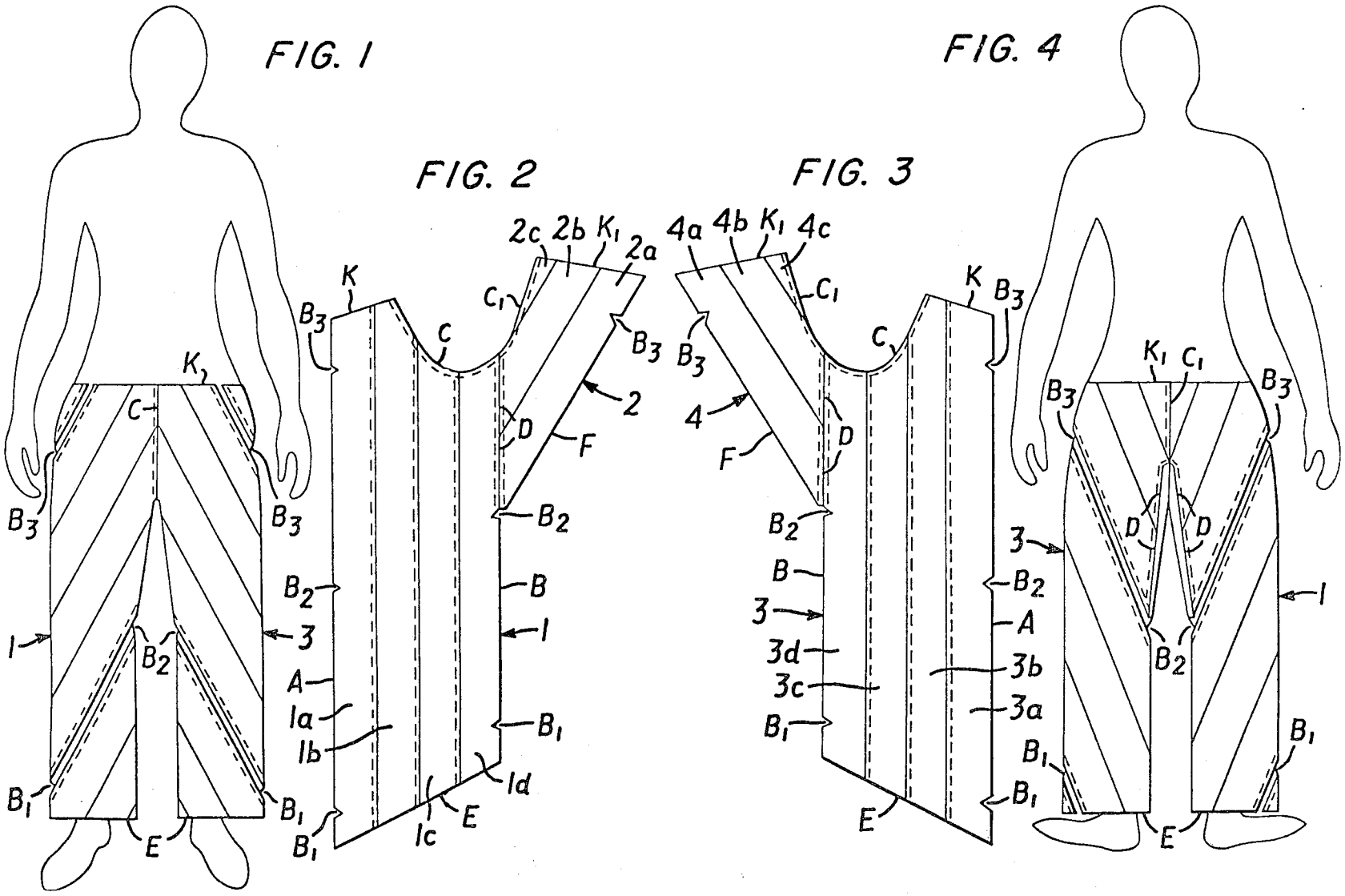
FIG. 1 is a front view of a pants-type garment in accordance with the present invention.
FIG. 2 shows the material of which the right leg of the garment shown in FIG. 1 is formed.
FIG. 3 shows the material for the left leg.
FIG. 4 is a rear view of the garment.

In the accompanying drawings, FIGS. 1 and 4 are respectively front and rear views of a pants-type garment made in accordance with the present invention. FIGS. 2 and 3 show the material from which the garment is made, FIG. 2 showing the material for the right leg of the garment and FIG. 3 showing the material for the left leg. Upper portions of the material shown in FIGS. 2 and 3 form a body portion of the garment when the two legs are assembled as illustrated in FIGS. 1 and 4.

The material for the right leg of the garment is shown in FIG. 2 as comprising an elongated band 1 and a side extension piece 2. The band 1 is shown as having two parallel side edges A and B, an inclined lower edge E and a contoured upper edge comprising an inclined portion K which is approximately parallel to the lower edge E and a curved portion C. The band 1 is shown as being made up of a plurality of strips of material 1*a*, 1*b*, 1*c*, 1*d* which are joined with one another by parallel seams.

The side extension piece 2 is shown as having an outer side edge F, an inner side edge having an upper portion $C_1$ and an inclined lower portion D and an upper end edge $K_1$. The inclined lower side edge portion D of the side extension piece 2 is shown joined to an upper portion of the side edge B of the band 1, for example by a seam, so that the side extension piece 2 extends laterally at an angle from the upper portion of the band 1. Moreover, it will be seen that the outer side edge F of the side extension piece 2 forms an angular extension of the side edge B of the band 1 while the upper portion $C_1$ of the inner side edge forms an extension of the edge C of the band. The side extension piece 2 is shown by way of example as being made up of two strips of material 2*a* and 2*b* and a smaller triangular piece 2*c* joined by parallel seams.

The material for the left leg is shown in FIG. 3 as comprising an elongated band 3 and a side extension piece 4. It will be seen that the material for the left leg is the same as that for the right leg except for being reversed. Thus the band 3 is shown as being composed of four strips 3*a*, 3*b*, 3*c*, 3*d* and having parallel side edges A and B, an inclined lower edge E and a contoured upper edge C, K. Likewise, the side extension piece 4 is shown as being comprised of two strips 4*a*, 4*b* and a triangular piece 4*c* and having an outer side edge F, an upper edge $K_1$ and an inner side edge having an upper portion $C_1$ and an inclined lower portion D which is shown joined with an upper portion of the side edge B of the band 3 so that the side extension piece 4 extends laterally at an angle from the upper portion of the band 3.

While the bands 1 and 3 are shown as being made up of four strips of material, it will be understood that each of the bands can, if desired, be a single piece of material or can be made up of two, three or more strips or pieces. When two or more strips of material are used, the strips can be of the same width as shown by way of example in the drawings or can be of different widths. Moreover, the individual strips can be of the same material or of different material. For example the material can be of different colors or of different fabric construction. Thus one or more strips can be of elastic material or of apertured material such as lace or net. Likewise, each of the side extension pieces 2, 4 can be a single piece of material or can be made up of two or more strips or pieces. The material used for the side extension pieces 2, 4 can be different from that of the bands 1, 3 and, when the side extension pieces are made up of two or more strips or pieces of material, the individual strips or pieces can be of different material as described with respect to the bands 1, 3.

When the side extension piece 2 has been joined to the band 1 as illustrated in FIG. 2, the band together with the side extension piece is wound in a helical manner as illustrated in FIGS. 1 and 4 and the side edge A of the band 1 is joined to the free portion of the side B and to the edge F of the side extension piece 2 by a single helical seam to form the right leg and right side of the body portion of the garment. In order to illustrate the construction more clearly, the edge A is shown in FIGS. 1 and 4 as being slightly spaced from edges B and F instead of being joined. Notches $B_1$, $B_2$ and $B_3$ shown in the edges of the material in FIG. 2 are for the purpose of orienting opposite edges of the material when wound into helical form. Thus notches $B_1$, $B_2$, and $B_3$ in one edge mate respectively with notches $B_1$, $B_2$ and $B_3$ in the opposite edge of the material when wound helically. It will be seen that notch $B_2$ in the right edge is located at the junction of edge F of the side extension 2 with the edge B of band 1.

When the material shown in FIG. 2 is wound into helical form and adjacent edges of successive convolutions are joined by a helical seam as described above, the inclined edge E of the band 1 forms the lower edge of the leg as seen in FIG. 1. Such edge is suitably finished, for example by a hem or a cuff. The inclined edge K at the upper end of band 1 and the upper end edge $K_1$ of side extension piece 2 form portions of the waist of the garment while edge C of band 1 and edge $C_1$ of side extension piece 2 are joined with corresponding edges of the material for the left leg in a central junction line including the crotch of the garment.

The band 3 and side extension piece 4 which are to form the left leg and adjacent body portion of the garment are likewise wound in helical form (but in the opposite direction) and adjacent edges of successive convolutions are joined by a single helical seam as described above with respect to the right leg using notches $B_1$, $B_2$ and $B_3$ to line up successive convolutions. It will be understood that suitable marks can be used instead of notches and also that an operator may develope sufficient skill to eliminate the need of markers. When the left leg has been formed in the same manner as described above with respect to the right leg, edges C, $C_1$ of the right leg are joined with edge C, $C_1$ of the left leg along a central junction line thereby uniting the two legs and forming the body portion of the garment. It will be understood that the usual fly construction can be provided in a forward portion of the junction line or that a slide fastener may be provided at the rear. Alternatively a slide fastener can be provided in an upper portion of the junction line between the edge A and the edge F, for example above the point $B_3$. The edges K and $K_1$ forming the waist of the garment are suitably finished by a waist band.

As will be seen from FIG. 1, upper portions of the junction line between edges A and F are in convenient locations for openings for front pockets. Rear pockets, for example patch pockets, can be provided on rear portions of the garment formed by side extension pieces 2 and 4. Such pockets can be provided while the material is still in flat form as shown in FIGS. 2 and 3 thereby simplifying the construction.

The side extension pieces 2 and 4 provide for construction of pants-type garments in larger sizes or with fuller cuts. It will be seen that the side extension pieces not only provide more room in the waist and seat of the garment but also that the lower point of the side extension piece at $B_2$ occurs approximately at the knee of the garment which allows for a good freedom of movement. The size of the side extension piece can be varied according to the size of the garment as can also the angle between edges D and F which determine the angle at which the side piece 2, 4 extends from the band 1, 3. It has been found that this angle should usually be within the range of 20 to 45 degrees. While the side pieces 2, 4 could be cut integrally with the bands, 1, 3, less waste of material can usually be achieved by cutting the side extension pieces separately and joining them with the bands. As the bands 1 and 3 are straight bands of uniform width, they can be cut with minimum material wastage. Likewise, the side pieces 2, 4 can be laid out on material in such manner as to keep wastage at the minimum. Thus as illustrated in FIGS. 2 and 3, the side extension pieces 2, 4 are half the width of the bands 1, 3 so that they can be cut economically from the same material—the small triangular pieces 2*c*, 4*c* being cut from "scraps".

While full length trousers have been shown in FIGS. 1 and 4, it will be understood that the legs of the garment can be of any desired length. Thus the construction in accordance with the present invention is equally applicable to such garments as cullottes and shorts. Likewise the garment can have an upper portion extending above the waist as in the case of overalls and coveralls.

Figures 5, 6, 7, 8:
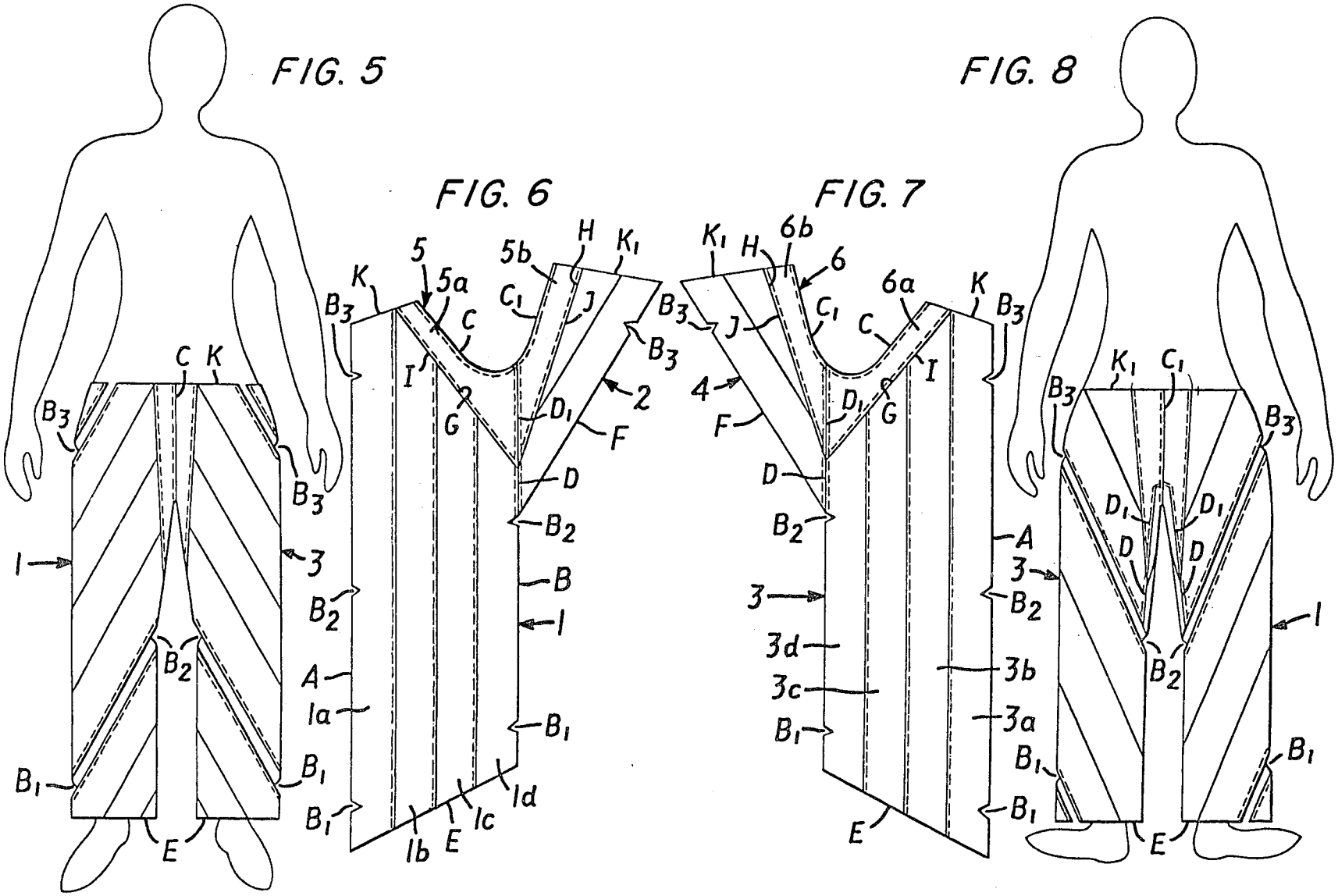
FIG. 5 is a front view of a garment similar to that of FIG. 1 but embodying a crotch band.
FIG. 6 shows the material from which the right leg of the garment of FIG. 5 is formed.
FIG. 7 shows the material for the left leg.
FIG. 8 is a rear view of the garment shown in FIG. 5.

In FIGS. 5–8 there is shown a pants-type garment which is like that shown in FIGS. 1–4 except for the incorporation of a crotch band. FIGS. 5 and 8 show the front and rear of the garment respectively while FIGS. 6 and 7 show the material for the right leg and left leg respectively. Except for the crotch band, the several parts are designated by the same reference characters as in FIGS. 1–4.

As seen in FIG. 6, the material for the right leg of the garment comprises a band 1, a side extension piece 2 and a crotch band 5. The upper edge of the material comprising the band 1 and the side extension piece 2 is contoured so as to provide spaced portions K and $K_1$ shaped to form the waist of the garment and a reentrant intermediate portion defined by edges G and H for reception of the crotch band. The crotch band is shown as being formed of two pieces of material 5*a* and 5*b* which are joined end-to-end at an angle to one another along a line $D_1$ so as to form a crotch band which is generally V-shaped. Outer edges I, J of the crotch band are joined respectively with edge G of band 1 and H of side extension piece 2, for example by seams. Whereas outer edges I, H of the crotch band are straight and meet at an acute angle to one another, the opposite inner edges C, $C_1$ are curved and are adapted to be joined with corresponding edges of the crotch band of the other leg to form the crotch of the garment.

The crotch band 5 is shaped to provide greater fullness in the crotch than would be provided by a flat piece of material fitting into the V-shaped recess formed by edges G and H of the band 1 and side extension piece 2. Thus if the material comprising the band 1 and side extension piece 2 is laid flat on a plane surface, the crotch band 5 will not lie flat but will bulge or buckle upwardly. When the crotch band is in free condition, i.e. before being joined to band 1 and side extension piece 2, the outer edges I, J of the crotch piece define an angle which is larger than the angle defined by edges G and H of band 1 and side extension piece 2 when laid flat on a plane surface. Hence, when the crotch band 5 is assembled with the band 1 and side extension piece 2, opposite sides or arms of the V-shaped crotch band are forced toward one another, thereby providing greater fullness in the crotch band. While the crotch band 5 can, if desired, be made of a single V-shaped piece of material, it is advantageous to form it of two pieces 5*a* and 5*b* as shown in order to avoid fabric wastage and provide greater opportunity for shaping the crotch band as desired.

The material shown in FIG. 7 for forming the left leg in like manner comprises a band 3, side extension piece 4 and crotch band 6 comprising two parts 6*a* and 6*b* joined end-to-end at an acute angle to one another. The material shown in FIG. 7 is thus of the same size and shape as that of FIG. 6 except that it is reversed.

When the parts have been assembled as illustrated in FIG. 6, the band 1 together with side piece 2 and crotch band 5 is wound helically as illustrated in FIGS. 5 and 8 and edge A is joined with edges B and F in a single helical seam to form the right leg and associated body portion of the garment. In like manner the band 3 together with side extension piece 4 and crotch band 6 are wound helically (in the opposite direction) to form the left leg. The edges C and $C_1$ of crotch band 5 are thereupon joined with corresponding edges of crotch band 6 so as to unite the crotch bands with one another and thereby join the two legs and form the body portion of the garment.

The crotch bands 5 and 6 can, if desired, be of different material from the bands 1, 3 and side extension pieces 2, 4. For example the crotch bands can be more elastic either by reason of being cut on a bias or being cut from more elastic material. When the crotch bands are formed of two parts as shown, the two parts can, if desired, be of different material. Except for the crotch band as described above, the pants-type garments of FIGS. 5 to 8 is the same as that of FIGS. 1–4 and is made in like manner. It is likewise subject to the same variations as have been pointed out above with respect to FIGS. 1–4.

Figures 9, 10, 11, 12:
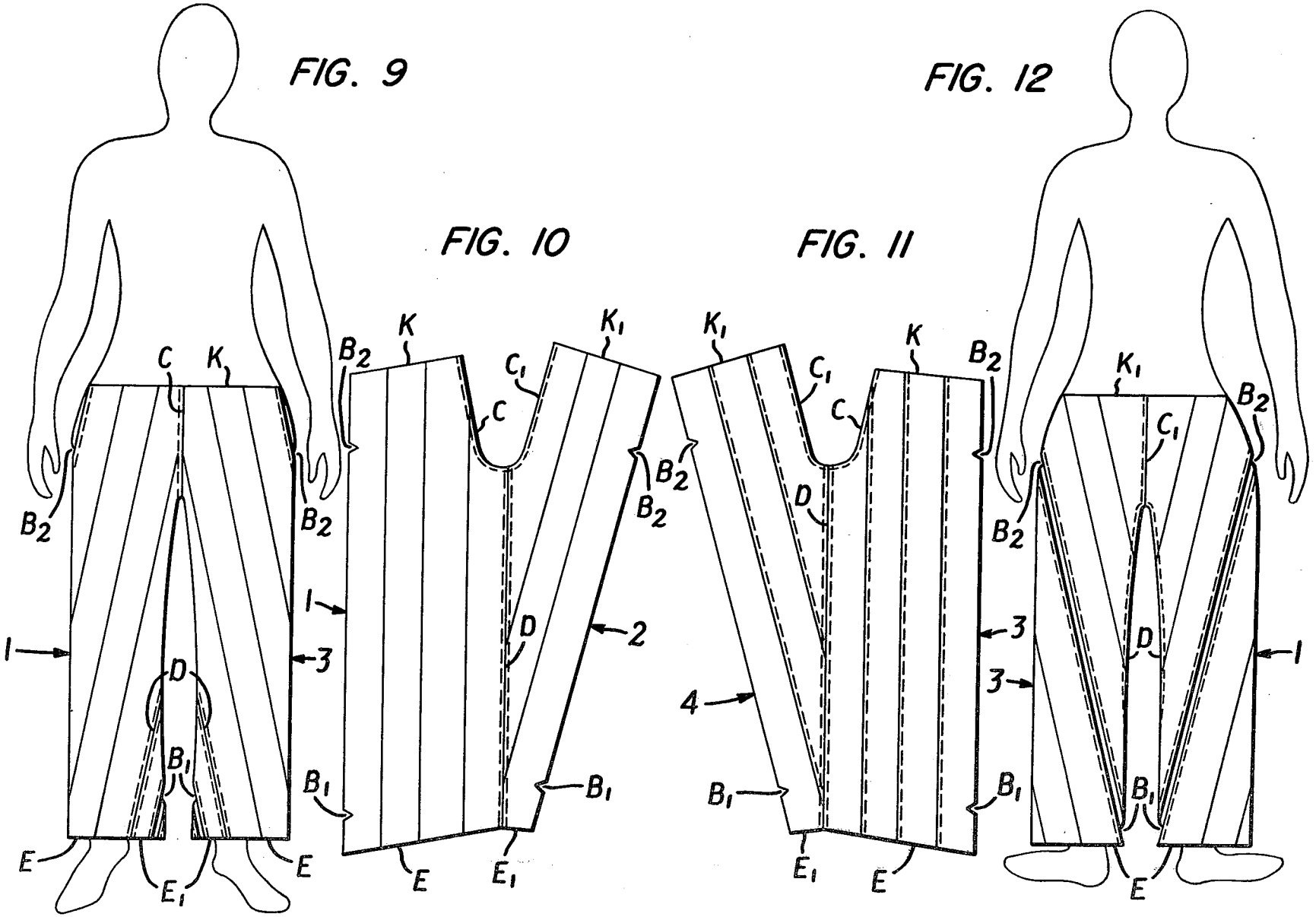
FIG. 9 is a front view of a further embodiment of a pants-type garment in accordance with the present invention.
FIG. 10 shows the material of which the right leg of the garment shown in FIG. 9 is formed.
FIG. 11 shows the material for the left leg.
FIG. 12 is a rear view of the garment.

In FIGS. 9–12 there is illustrated another embodiment of a pants-type garment in accordance with the invention which is like the garment illustrated in FIGS. 1–4 except that the side extension pieces 2 and 4 are longer, extending down to the lower edge E of the band and having a short lower edge $E_1$ which forms an extension of the lower edge E of the band. FIG. 9 is a schematic front view of the garment while FIG. 12 is a schematic rear view. FIG. 10 shows the material for the right leg of the garment while FIG. 11 shows the material for the left leg. Corresponding parts are identified by the same reference characters as in FIGS. 1–4. The garment shown in FIGS. 9–12 is of the same construction as that of FIGS. 1–4 and is made in like manner except for the greater length of the side extension pieces 2 and 4.

While FIGS. 1–4 and FIGS. 9–12 illustrate two lengths of side extension pieces, it will be understood that other lengths of side extension pieces can be used, the length being selected for the particular cut of the garment desired. While the side extension pieces illustrated in FIGS. 2 and 3 extend down approximately to knee level of the finished garment as illustrated in FIGS. 1 and 4, the side extension pieces can, if desired, be shorter or can be longer, the upper limit being about 4 inches below the crotch and the lower limit being the lower edge of the garment. The maximum width of the side extension piece can be equal to, less than or greater than the width of the respective band.

Opposite side edges A and B of the bands 1 and 3 are straight and parallel with one another. This makes it possible to cut the bands from stock fabric of predetermined width with maximum material utilization as will be explained below. The outer side edges F of the side extension pieces 2 and 4 are also straight. Although the lower portions D of the inner side edges of the side extension pieces 2 and 4 appear straight, for example in FIGS. 2 and 3 of the drawings, by reason of being joined with the side edges B of the bands, they are preferably cut with a concave curve that may, for example, deviate about 2 inches from a straight line. The curve is preferably not uniform but approximately parabolic. This has been found to give a better shape to the garment. The edges C and $C_1$ forming the crotch cutout are also curved. The location of the crotch cutout with respect to the band and side extension pieces can be varied according to the cut of the garment. For example, the crotch cutout may be provided solely or mostly in the band. By varying the position of the crotch cutout, the fullness in the seat of the garment can be increased or decreased as desired.

The direction of rotation in which the bands together with their side extension pieces are helically wound can be reversed from that shown in the drawings. Moreover, the angle of the helix can be changed. The material should make at least $\frac{1}{8}$ turn in the length of the trousers and may make at least $\frac{1}{4}$ turn or $\frac{1}{2}$ turn. Moreover, it is desirable to wind the fabric helically in the manner illustrated in the drawings so that an upper portion of the helical junction line comes in a position to form front pocket openings as illustrated in FIGS. 1, 5 and 9.

Figure 13:
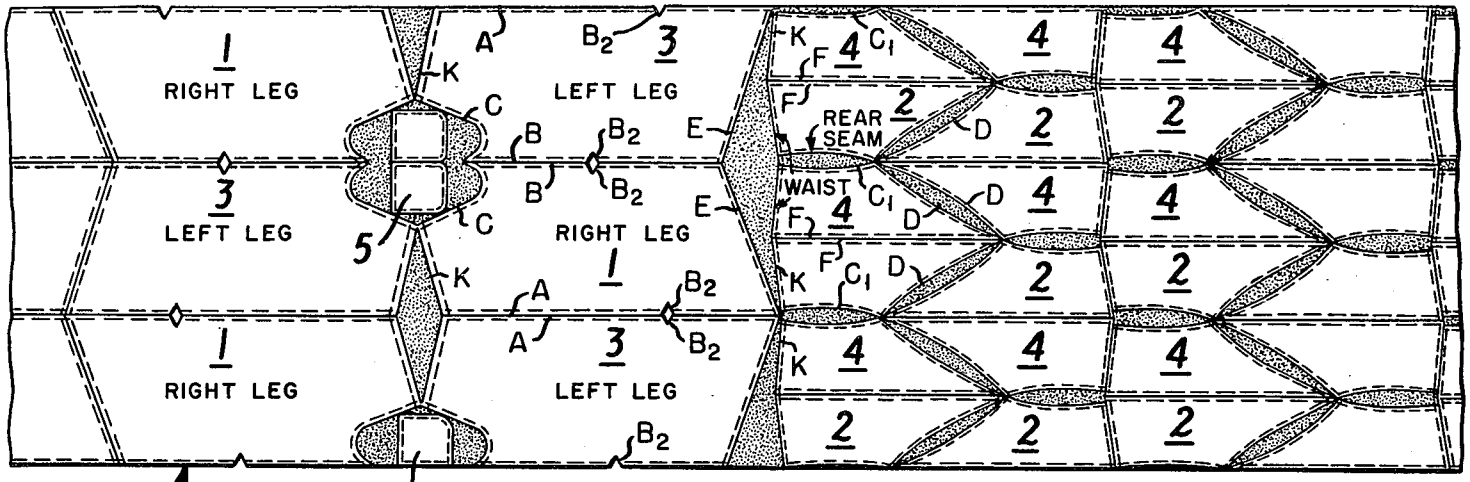
FIG. 13 is a schematic view illustrating how pieces of material for forming a pants-type garment of the kind illustrated in FIGS. 1–4 are laid out on stock material in a manner to attain a high degree of material utilization.

The construction of a garment of helically joined pieces makes it possible to attain a high degree of fabric utilization. This is illustrated for example in FIG. 13 which shows a possible layout of pieces for producing a pants-type garment of the kind shown in FIGS. 1–4. While the bands 1 and 3 for the right leg and left leg respectively are shown in FIG. 13 as being formed of a single piece rather than being made up of four strips as illustrated in FIGS. 2 and 3, it will be understood that the bands can be composed of two or more strips. Likewise the side extension pieces 2 and 4 are shown in FIG. 13 as single pieces but can be composites made of strips. In FIG. 13 the stippled areas represent waste fabric areas although portions of these areas can be used for smaller pieces such as for patch pockets 5, waist bands, facings, etc.

As the bands 1 and 3 have straight parallel edges, they can be laid side-by-side. Moreover, the width of the bands 1 and 3 can be selected so that the sum of the width of the bands is equal to the width of the stock material M. For example three bands each 20 inches wide can be cut from 60 inch material. In like manner four 18 inch bands can be cut from 72 inch material. With a helical construction in accordance with the invention a band of precise width is not required for a particular size of garment. Conversely, garments of different size can be made with the same width of band. Thus for example in making pants, sizes 32, 34 and 36 may be made from the same width of band. Different sizes are produced by using bands of the same width but of different length. Hence, the band width can be selected so as to obtain complete utilization of the width of the material. In some instances it may be desirable to include one or more bands other than the bands to be wound helically, e.g. a band for use as a waist band.

Moreover, as seen at the left-hand side of FIG. 13, the straight but inclined end edges of the strips are fitted together so as to obtain complete fabric utilization.

As illustrated by way of example in FIG. 13, the side extension pieces 2 and 4 are of such width that the width of two side extension pieces is equal to the width of the band 1 or 3. Moreover, two side extension pieces are fitted together so that the inclined edges D overlap. If these edges were straight they would be coincident with one another. However, by reason of the edges being concavely curved as described above, there is a small amount of space between them which may or may not be used for small pieces. Likewise, there are small spaces between edges $C_1$ by reason of these edges being concavely curved. It will be seen that the straight but inclined edges K are fitted together so that there is no waste fabric between them.

As seen from a central portion of FIG. 13, there is waste material between the portion from which the bands 1 and 3 are formed and the portion from which the side extension pieces 2 and 4 are formed. However, as one length of material may be used for producing bands 1 and 3 and another length for producing side extension pieces 2 and 4, these waste areas do not recur. Moreover, they are such size that they can advantageously be used for smaller pieces such as facings or trim.

Figure 14:
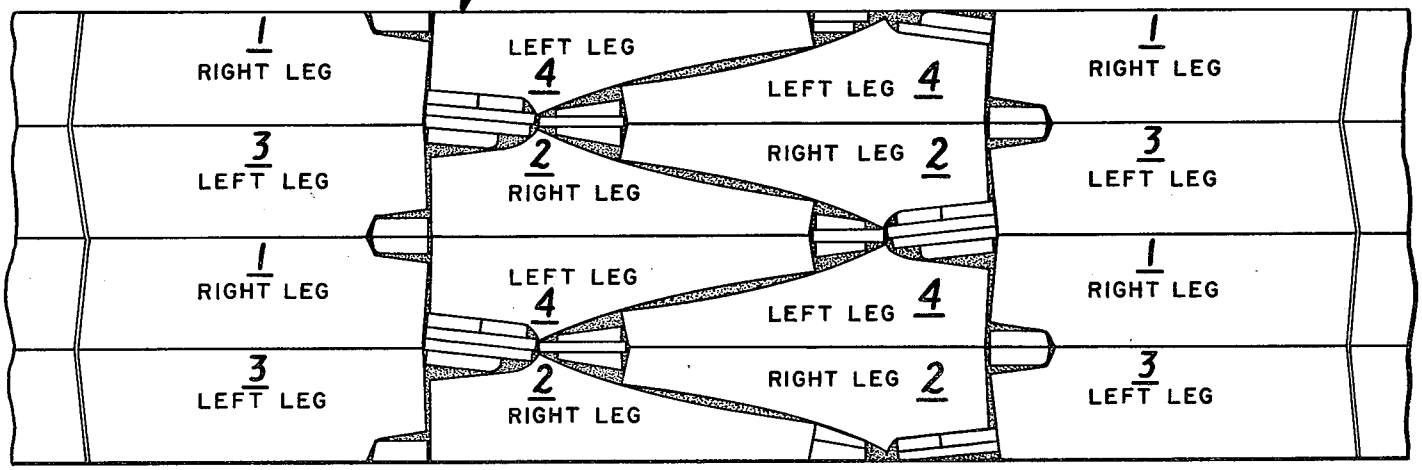
FIG. 14 is a similar schematic view showing the layout of pieces for making a pants-type garment of the kind shown in FIGS. 9–12.

FIG. 14 illustrates by way of example a layout of bands and side extension pieces for producing a pants-type garment of the kind illustrated in FIGS. 9–12. Here again the bands 1 and 3 are of such width that the sum of the widths of the bands is equal to the width of the material M. In the construction illustrated, the side extension pieces 2 and 4 have a maximum width approximately equal to the width of the respective band. By reason of the side extension pieces being tapered, they can be overlapped as shown so as to attain a high degree of material utilization. Moreover, areas not occupied by the bands and side extension pieces can be used for smaller pieces such as pockets, waistbands, crotch facings, etc. As will be seen from FIGS. 13 and 14, many of the edges are straight so that edges of adjacent pieces are coincident. This not only avoids fabric waste but also reduces the number of cutting operations required since only a single cut is required between two adjacent pieces. Moreover, since straight edges of the outermost pieces are coincident with the edges of the fabric, there is provided a finished edge, thereby reducing the total of edge finishing operations.

Whereas FIGS. 13 and 14 illustrate the layout of pieces for the construction of pants-type garments, it will be understood that similar material utilization can be attained in producing dress-type garments formed of helically wound bands. The term "dress-type garments" is used broadly to include dresses, slips, blouses, coats, jackets, nightgowns, hostess coats, skirts and other sheath-type garments for covering or partially covering the torso and in some cases the legs of a wearer.

Figures 15, 16, 17, 18, 19:
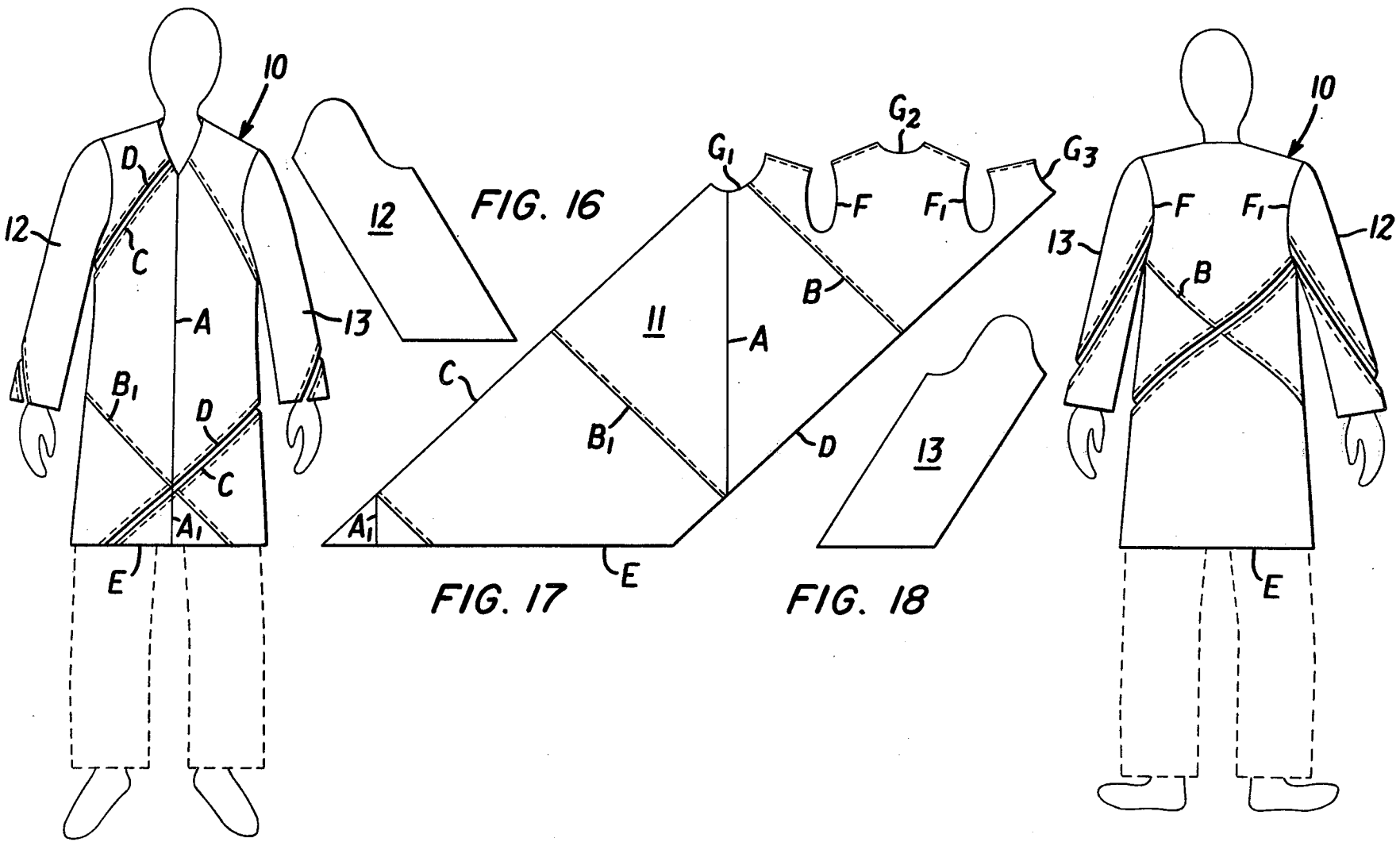
FIG. 15 is a front view of a dress-type garment.
FIGS. 16 to 18 show the material of which the garment of FIG. 15 is made.
FIG. 19 is a rear view of the garment.

By way of example there is shown in FIGS. 15 to 19 a mid-length jacket or coat 10. A front view of the coat is shown in FIG. 15 while a back view is shown in FIG. 19. FIG. 17 shows a band of material 11 which is wound helically to form the body portion of the garment while FIGS. 16 and 18 show bands of material 12 and 13 which are wound helically to form the sleeves. As seen in FIG. 17 the band of material 11 is generally in the form of a parallelogram with straight parallel sides C and D and inclined end edges. When the band 11 is wound helically, edge C is joined with edge D, for example by a seam, to form the body portion of the garment. The inclined end edge E of the band forms the bottom of the garment. Edges F and $F_1$ form arm holes to receive the sleeves while edges $G_1$, $G_2$ and $G_3$ form the neckline. The lines A and $A_1$ together form a central front opening which is closed, for example, by a slide fastener. To provide the front opening, the fabric can be cut along the lines A, $A_1$ either before or after the band 11 has been wound helically to form the body portion of the garment. Lines B and $B_1$ represent mock seams which, for reasons of appearance, are symmetrical with the seam joining edges C and D. The material can, if desired, be cut along lines B and $B_1$ and sewed back together, but it is usually simpler to form mock seams without cutting the fabric. The seams or mock seams along lines B and $B_1$ can be omitted if symmetry of appearance is not required. The bands 12 and 13 are wound helically and opposite edges of the helically wound bands are joined to form sleeves of the garment which are set in the arm holes provided by the cutouts F and $F_1$.

Figure 20:
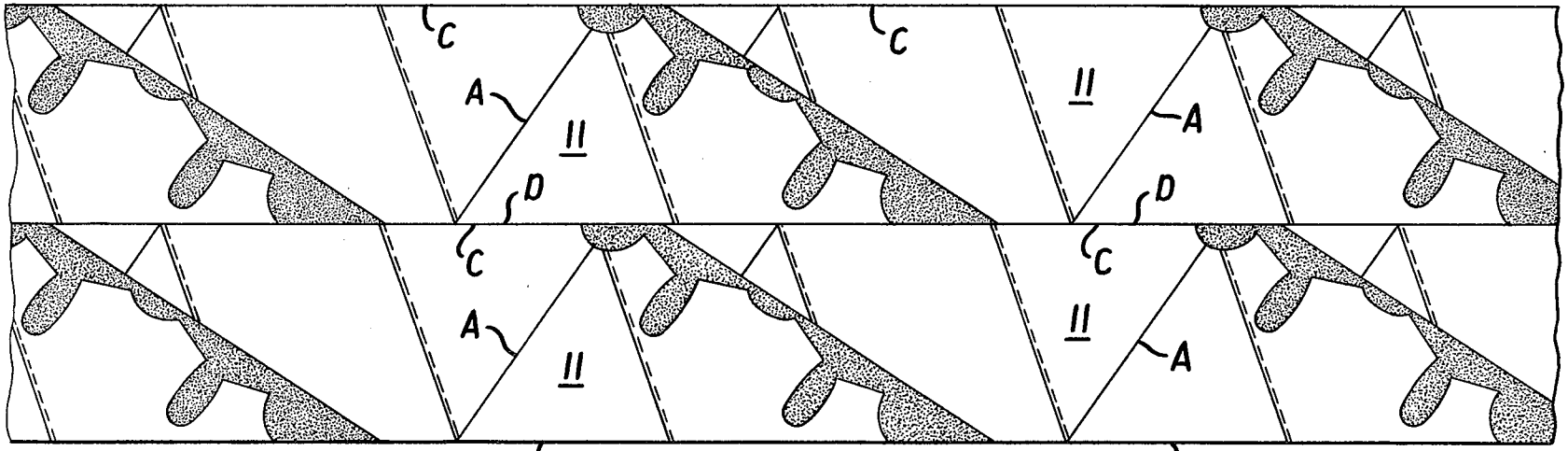
FIG. 20 illustrates schematically how the material of FIG. 17 is laid out on stock material.

FIG. 20 illustrates by way of example how the bands 20 of the garment 10 may be cut from stock material of a given width. As illustrated in FIG. 20, two bands are laid out on the material side-by-side, each band having a width equal to half the width of the material. If wider material is used, there may be three tiers of bands in the width of the material. The width of the band for producing a given size of garment is not critical since for the same size garment it is possible to use a narrower and longer band or a wider and shorter band. Moreover, bands of the same width can be used in producing garments of different size by using a longer band for larger garments. This flexibility in the selection of band width makes it possible to adjust the width of the bands to the width of the fabric being used so as to attain maximum fabric utilization.

The bands 12 and 13 for forming the sleeves may be cut from a different portion of the fabric, the bands being laid side-by-side and the width of the bands being selected so as to attain maximum utilization of the fabric. Here again the width of the bands is not critical since a sleeve of the desired size and length can be obtained by selecting the proper length of the band. Alternatively, the bands 12 and 13 for producing the sleeves may be laid out alongside the bands 11 for producing the body portion of the garment.

Figures 21, 22, 23, 24, 25:
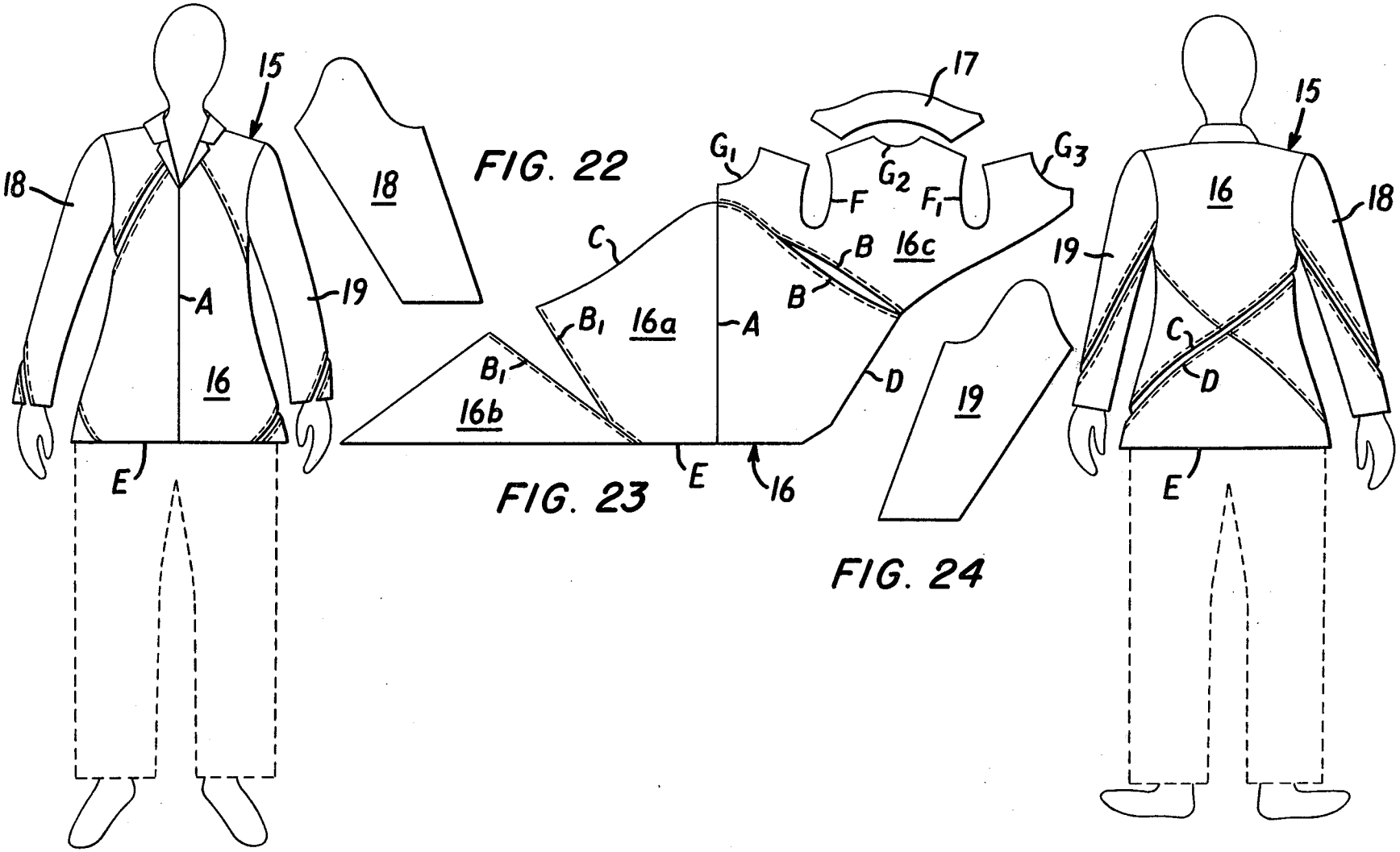
FIG. 21 is a front view of a jacket.
FIGS. 22 to 24 show the material of which the jacket of FIG. 21 is made.
FIG. 25 is a rear view of the jacket.

In FIGS. 21 to 25 there is shown by way of example a jacket 15 formed of helically wound material. A front view of the jacket is shown in FIG. 21 while FIG. 25 is a rear view. FIG. 23 shows a band of material 16 which is wound helically to form the body portion of the garment and a small band 17 for the collar. FIGS. 22 and 24 show bands 18 and 19 which are wound helically to form the sleeves.

The garment shown in FIGS. 21 to 25 differs from that of FIGS. 15 to 19 in that it is shorter and is cut so as to provide more shape. Thus instead of being completely straight as shown in FIG. 17, the edges C and D which are joined with one another when the band 16 is wound helically are somewhat curved. Moreover, the material is cut along lines B and along lines $B_1$ so as to divide the band 16 into pieces 16*a*, 16*b* and 16*c*. The opposite edges B are subsequently joined with one another as are also the edges $B_1$ so as to form the band 16 which is thereby given a predetermined shape. Hence, when the band 16 is wound helically, it is given a body-conforming shape as illustrated in FIGS. 21 and 25. As in FIG. 17 the edge E forms the bottom of the garment, cutouts F and $F_1$ form arm holes and edges $G_1$, $G_2$ and $G_3$ form a neckline to which band 17 forming a collar is joined. As seen in FIGS. 22 and 24, the bands 18 and 19 which are helically wound to form the sleeves are somewhat tapered so as to shape the sleeves.

Figure 26:
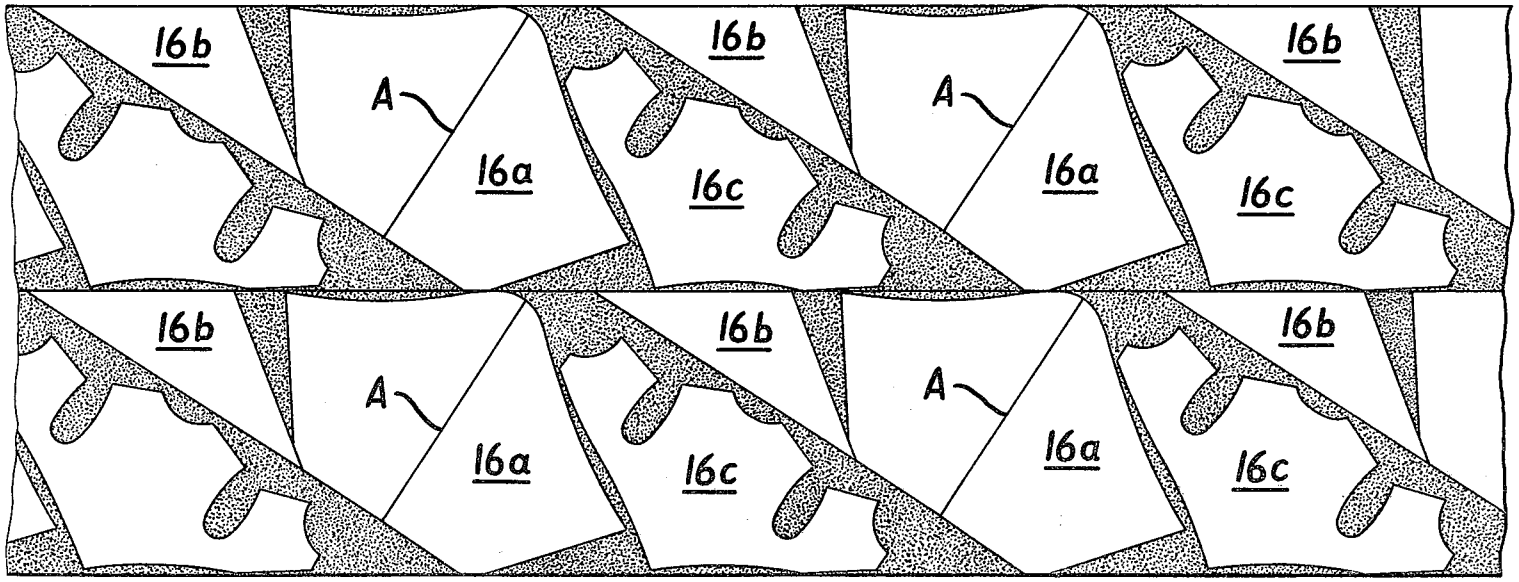
FIG. 26 illustrates schematically how the material of FIG. 23 is laid out on stock material.

FIG. 26 illustrates by way of example a layout on stock fabric of the pieces 16*a*, 16*b* and 16*c* which together form the band 16 which is wound helically to form the body portion of a garment illustrated in FIGS. 21 to 25. By reason of the shaping described above, there is somewhat more waste (as indicated by stippled areas) than in FIG. 20. However, the degree of fabric utilization is still high since, as described above, the width of the bands can be adjusted so as to make full use of the width of the material. Moreover, material not utilized in cutting the bands 16 can be used for smaller pieces such as collars, cuffs, pockets, or trim. The bands 18 and 19 for forming the sleeves can be cut from a different portion of the fabric or can be laid alongside bands 16 for forming the body portion of the garment.

As in the pattern layouts illustrated in FIGS. 13, 14 and 20, garments of different sizes, within limits, can be produced with bands of a given width by varying the length of the bands and controlling the helical winding of the bands to obtain garments of the desired size. Thus if a larger size garment is to be produced, a longer band is used and is wound in larger convolutions. This makes it possible to select a band width which makes maximum utilization of the stock material and yet produce garments of various sizes by appropriately adjusting the band length and adjusting the angle of inclination of the ends of the band according to the angle of the helix in which the band is wound.

By reason of this, the process of the present invention lends itself to computerization. Since the length of the band required for a given size of garment and the angle of inclination of the ends of the band are functions of the band width and the size of garment to be produced, it is sufficient to lay out and feed into a plotting computer the pattern for a garment of one size, whereupon the computer, through appropriate programming, will plot patterns for other sizes of like garments made from bands of the same width. For this purpose computers heretofore used in fabric grading/marking systems, such as the Camsco or Hughes marking systems, can be used. Other possible computers are the Gerber System 91 and a new Hewlett-Packard 7580A large format plotter.

In contrast with prior production methods with which a material utilization of 80% is considered good and 85%–90% is considered very good, a material utilization of 95% is readily obtainable by the method of the present invention. In large scale production this increased material utilization constitutes an important economic factor.

While preferred embodiments of the invention have been illustrated in the drawings and are herein particularly described, it will be understood that many modifications and variations are possible and that the invention is hence in no way limited to the illustrated embodiments.

What is claimed is:

1. In a method of making a pants-type garment having two legs, a waist and a crotch, the steps of providing first and second bands of material each having first and second side edges, a lower edge and an upper edge, providing first and second side extension pieces of material each having an upper end, an outer side edge and an inner side edge having an upper portion and a lower portion inclined to said outer side edge, joining said lower portion of said inner side edge of said first side extension piece with at least an upper portion of the first side edge of said first band and joining said lower portion of said inner side edge of said second side extension piece with at least an upper portion of said first side edge of said second band so that said side extension pieces extend laterally at an angle from respective bands with the outer side edge of each side extension piece forming an angle with said first side of the respective band and with said second upper portion of the inner side edge of each side extension piece forming an extension of the upper edge of the respective band, said upper portion of the inner side edge of each side extension piece and an adjacent portion of the upper edge of the adjacent band being shaped to form the crotch of the garment, winding said first bsnd with its side extension piece helically and joining contiguous edges of edges of convolutions in a helical junction line to form a first leg of said garment, winding said second band with its side extension piece helically and joining contiguous edges of convolutions in a helical junction line to form a second leg of said garment, and joining said crotch-forming edge portions of said first band and respective side extension piece with said crotch-forming edge portions of said second band and respective side extension piece to thereby join said first and second bands and their respective side extension pieces to form said garment.

2. A method according to claim 1, in which each of said bands is formed of a plurality of parallel strips of material having side edges joined to form said band.

3. A method according to claim 1 or 2, in which each of said side extension pieces is formed of a plurality of parallel strips of material having side edges joined to form said side extension piece.

4. A method according to claim 1, in which said outer side edge of each of said side extension pieces extends at an angle of between 20° and 45° to said first side edge of the respective band.

5. A method according to claim 1, in which the junction of said lower portion of the inner side edge of each of said side extension pieces with said first side edge of the respective band extends down approximately to knee level of said garment.

6. A method according to claim 1, in which the junction of said lower portion of the inner side edge of each of said side extension pieces with said first side edge of the respective band extends below knee level of said garment.

7. A method according to claim 1, in which an upper portion of the junction line between said second side edge of each of said bands and said first side edge of the respective side extension piece is positioned to form a front pocket opening of said garment.

8. A pants-type garment comprising first and second bands of material each having first and second side edges, an upper end edge and a lower end edge, first and second side extension pieces each having an upper end, an outer side edge and an inner side edge having an upper portion and a lower portion inclined to said outer side edge, said lower portions of the inner side edges of said first and second side extension pieces being joined with at least upper portions of said first side edges of said first and second bands of material respectively, each of said bands of material with its respective side extension piece being wound helically to form a leg of said garment, means joining contiguous edges of convolutions in a helical junction line, upper end portions of said bands of material and respective side extension pieces being shaped to form a body portion of said garment, and means joining an upper portion of said first band of material and its respective side extension piece with an upper portion of said second band of material and its respective side extension piece to unite said legs and form said body portion of said garment.

9. A pants-type garment according to claim 8, in which each of said bands comprises a plurality of strips of material having side edges joined to form said band.

10. A pants-type garment according to claim 8 or 9, in which each of said extension pieces comprises a plurality of strips of material having side edges joined to form said side extension piece.

11. A pants-type garment according to claim 8, in which the junction of said lower portion of the inner side edge of each of said side extension pieces with said first side edge of the respective band of material extends down approximately to knee level of said garment.

12. A pants-type garment according to claim 8, in which the junction line between said lower portion of the inner side edge of each of said side extension pieces with said first side edge of the respective band of material extends down below knee level of said garment.

13. A pants-type garment according to claim 8, in which the junction line between said second side edge of each of said bands of material and said first side edge of the respective side extension piece is positioned to form a front pocket opening of said garment.

14. In a process of making, from stock material of predetermined width, garments formed by winding at least one band of material helically and joining contiguous edges of convolutions to form said garment, the procedure of laying out a plurality of bands side-by-side on said material with the sum of the widths of said bands equal to said predetermined width of said material, whereby waste of material is avoided, cutting said bands from said material, winding resulting bands helically while controlling the helical winding of the bands to produce garments of predetermined sizes independent within limits of the width of said bands, and joining contiguous edges of convolutions to form said garments.

15. A process according to claim 14, in which opposite edges of said bands of material are straight and edges of adjacent bands are contiguous, whereby a single cut forms edges of two adjacent bands.

16. A process according to claim 14, in which said bands laid out side-by-side are of equal width.

17. A process according to claim 14, in which the garments to be produced are pants-type garments formed of bands of material and tapered side extension pieces each having an inclined side and opposite straight side, and in which said side extension pieces are laid out with inclined sides of a pair of side extension pieces facing one another and opposite straight sides parallel to one another and to the edges of said stock material.

18. A process according to claim 17, in which said side extension pieces of a pair are shifted lengthwise relative to one another to vary the combined width of said pair of side extension pieces, whereby the sum of the widths of pairs of side extension pieces laid side-by-side is equal to the width of said stock material.

19. A process according to claim 17, in which a plurality of said bands are laid side-by-side in one portion of said stock material and a plurality of pairs of said side extension pieces are laid side-by-side in another portion of said stock material.

20. A process according to claim 14, in which said bands have ends which are inclined with respect to side edges of said bands, and in which two bands are laid out end-to-end with an inclined end of one of said bands adjoining an inclined end of the other of said bands.

21. A process according to claim 14, in which the garments to be produced are dress-type garments and in which a band to be wound helically to form a body portion of the garment is cut as a plurality of pieces which are subsequently joined to form said band.

22. A process according to claim 14, in which a pattern layout for producing garments of a predetermined size with helically wound bands of a given band width is fed into a plotting computer, and in which said computer is programmed to plot pattern layouts for producing like garments of different sizes with helically wound bands of the same width but different lengths upon inputting the size of the garments to be produced.

* * * * *